US009272543B2

(12) United States Patent
Ohyama et al.

(10) Patent No.: US 9,272,543 B2
(45) Date of Patent: Mar. 1, 2016

(54) PRINTING DEVICE, TRAY AND CONVEYANCE DEVICE

(71) Applicant: CANON KABUSHIKI KAISHA, Tokyo (JP)

(72) Inventors: Kazuo Ohyama, Kawasaki (JP); Toshiaki Tokisawa, Kawasaki (JP); Atsushi Miyahara, Higashikurume (JP); Masanori Kaneko, Kawasaki (JP); Masaaki Matsuura, Kawasaki (JP); Hiroshi Nakai, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/573,161

(22) Filed: Dec. 17, 2014

(65) Prior Publication Data

US 2015/0183237 A1 Jul. 2, 2015

(30) Foreign Application Priority Data

Dec. 26, 2013 (JP) ..... 2013-269501

(51) Int. Cl.

| | |
|---|---|
| ***B41J 2/01*** | (2006.01) |
| ***B41J 11/58*** | (2006.01) |
| ***B41J 3/407*** | (2006.01) |
| ***B41J 11/06*** | (2006.01) |

(52) U.S. Cl.

CPC ..... *B41J 11/58* (2013.01); *B41J 3/4071* (2013.01); *B41J 11/06* (2013.01)

(58) Field of Classification Search

CPC ..... B41J 3/4071; B41J 2202/36; B41F 7/00
USPC ..... 347/104
See application file for complete search history.

(56) References Cited

U.S. PATENT DOCUMENTS

| | | | | |
|---|---|---|---|---|
| 3,826,351 | A * | 7/1974 | Fromme | 198/787 |
| 6,953,246 | B2 | 10/2005 | Takahashi et al. | |
| 2009/0269116 | A1 * | 10/2009 | Komuro et al. | 399/405 |
| 2009/0295896 | A1 * | 12/2009 | Komuro et al. | 347/104 |

FOREIGN PATENT DOCUMENTS

JP 2004-042384 A 2/2004

* cited by examiner

*Primary Examiner* — Jannelle M Lebron
*Assistant Examiner* — Jeremy Bishop
(74) *Attorney, Agent, or Firm* — Fitzpatrick, Cella, Harper & Scinto

(57) ABSTRACT

A printing device that prints on media held in a tray includes a first roller section including a first conveyance roller; a second roller section including a second conveyance roller and a pinch roller; and a printing section provided between the first and the second roller sections. Printing is performed on the top surface of the media in the printing section while the tray is being conveyed by the first and the second roller sections. The tray is such that friction surfaces having a coefficient of friction that is higher than that of the other portions of the tray are formed in portions that come in contact with the first conveyance roller when the tray is taken in by the first roller section and the tip end of the tray advances to a gripping section between the second conveyance roller and the pinch roller.

15 Claims, 11 Drawing Sheets

PRINTING DEVICE, TRAY AND CONVEYANCE DEVICE

BACKGROUND OF THE INVENTION

1. Field of the Invention

The present invention relates to a printing device that prints on media that is held in a tray, a tray that is guided to and conveyed inside the printing device in a state of carrying media that is to be printed on by the printing device, and a conveyance device that conveys the tray.

2. Description of the Related Art

Conventionally, when printing on media having a certain thickness such as a CD-R, DVD or card with a printing device, a media carrier tray (hereafter, also referred to as a carrier tray) for supplying media to the inside of the printing device and conveying media inside the printing device was used. For example, as illustrated in FIG. 10, there is a carrier tray that is constructed such that a tapered shape, the thickness of which becomes narrower going toward the front, is provided on the tip end of the main body of the carrier tray, and so that a thin plastic sheet that is thinner than the carrier tray is attached so as to protrude further toward the front than the tapered shape (Japanese Patent Laid-Open No. 2004-42384).

SUMMARY OF THE INVENTION

However, in the conventional art, there are prob1ems as will be described below. The conventional art will be explained using FIG. 10 and FIG. 11.

FIG. 10 is a top view illustrating a conventional carrier tray. The carrier tray 101 has a tray sheet 102 that is formed using thin plastic that is attached to the tip end. FIG. 11 is a partial cross-sectional view that schematically illustrates the state of the carrier tray illustrated in FIG. 10 being inserted into the printing device. The carrier tray 101 is inserted by a user from the front side when the printing device is used by the user until it reaches just before a conveyance roller nip that is formed from a conveyance roller 103 and pinch roller 104. After that, the carrier tray 101 is conveyed to the conveyance roller nip by the conveying force of a discharge roller 105 having a contact section 105*a* that is formed using rubber and that comes in contact with the carrier tray 101.

Here, the carrier tray 101 is formed using plastic, and because the coefficient of friction is relatively low, it is difficult to obtain a large conveying force. Moreover, when paper dust that is produced from media such as paper adheres to the discharge roller 105, it becomes easy for slipping to occur between the contact surfaces of the discharge roller 105 and the carrier tray 101, and there is a tendency for the conveying force of the discharge roller 105 to decrease. When the conveying force of the discharge roller 105 is too low, there is a possibility that the tray sheet 102 will not engage with the conveyance roller nip, and that conveyance that is to be performed by the conveyance roller 103 next will not be performed.

Therefore, the object of the present invention is to provide a printing device that prints on a media that is held in a tray, and that is able to sufficiently transmit driving force from the rollers that are used for conveying the tray to the tray, and obtain the desired conveying force.

In order to solve the problem described above, the printing device of the present invention is a printing device that prints on media that is held in a tray, including: a first roller section that includes a first conveyance roller; a second roller section that includes a second conveyance roller and a pinch roller; and a printing section that is provided between the first roller section and the second roller section; wherein printing is performed on the top surface of the media in the printing section while the tray is being conveyed by the first roller section and the second roller section; and wherein the tray is such that friction surfaces having a coefficient of friction that is higher than that of the other portions of the tray are formed in portions that come in contact with the first conveyance roller when the tray is taken in by the first roller section and the tip end of the tray advances to a gripping section between the second conveyance roller and pinch roller.

With the present invention, in a printing device that prints on media that is held in a carrier tray, it is possible to sufficiently transmit the driving force of rollers used in conveyance to the carrier tray, and to obtain a desired conveying force, and thus it is possible to suppress problems such as poor conveyance or shift in the position.

Further features of the present invention will become apparent from the following description of exemplary embodiments (with reference to the attached drawings).

DESCRIPTION OF THE EMBODIMENTS

In the following, embodiments of the present invention will be explained in detail with reference to the drawings. The drawings illustrate examples and do not limit the present invention.

(First Embodiment)

Figure 1A:
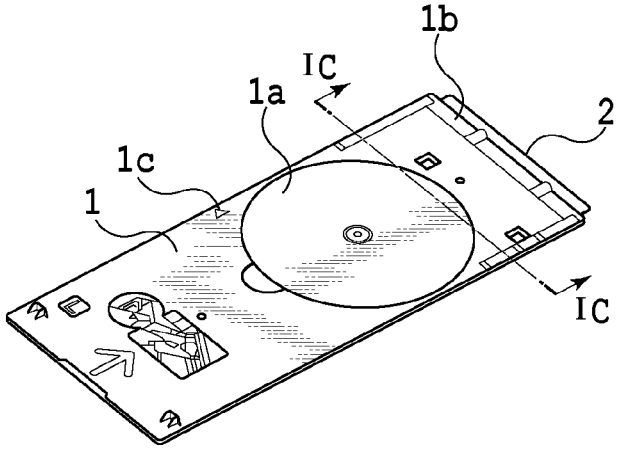
FIG. 1A to FIG. 1C illustrate a carrier tray of a first embodiment of the present invention.
Figure 1B:
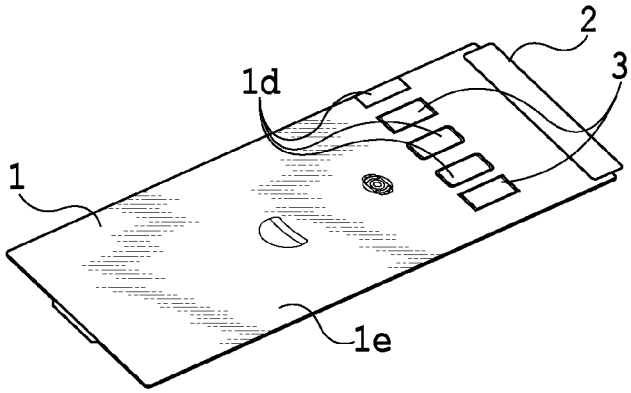
Figure 1C:
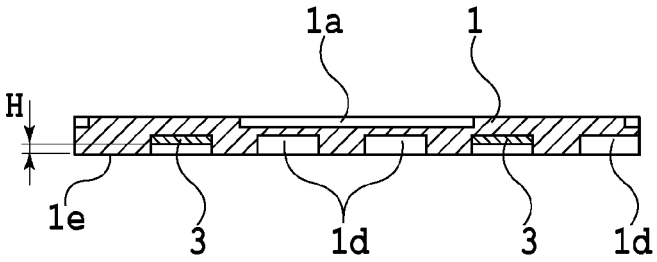

FIG. 1A to FIG. 1C illustrate a media carrier tray (hereafter, is also simply referred to as a carrier tray) of a first embodiment of the present invention. FIG. 1A is a perspective view illustrating the top surface of the carrier tray, which is the side where media is mounted, and FIG. 1B is a perspective view of the bottom surface of the carrier tray. FIG. 1C is a cross-sectional view of section Ic-Ic in FIG. 1A.

The carrier tray 1 comprises a mounting section 1*a* on the top surface for mounting media such as a CD-R, DVD and the like. Moreover, the carrier tray 1 has a tapered-shape portion 1*b* that is provided on the tip-end side so that when being inserted into the printing device the carrier tray 1 can be easily guided to the nip (narrow section) between a conveyance roller pair that will be described later. A tray sheet 2 that is formed using plastic having a thickness that is thinner than the carrier tray 1 is attached to the tapered-shape portion 1*b* so as to protrude further toward the tip-end side than the tapered-shape portion 1*b* when inserting the carrier tray 1 into the printing device. In this example, the carrier tray 1 is formed using plastic having a thickness of about 3 mm. On the back-side of the carrier tray 1, high-friction members 3 that have a coefficient of friction higher than that of the carrier tray 1 are attached. The construction of the carrier tray 1 will be described in detail with reference to FIG. 6A and FIG. 6B.

Figure 2:
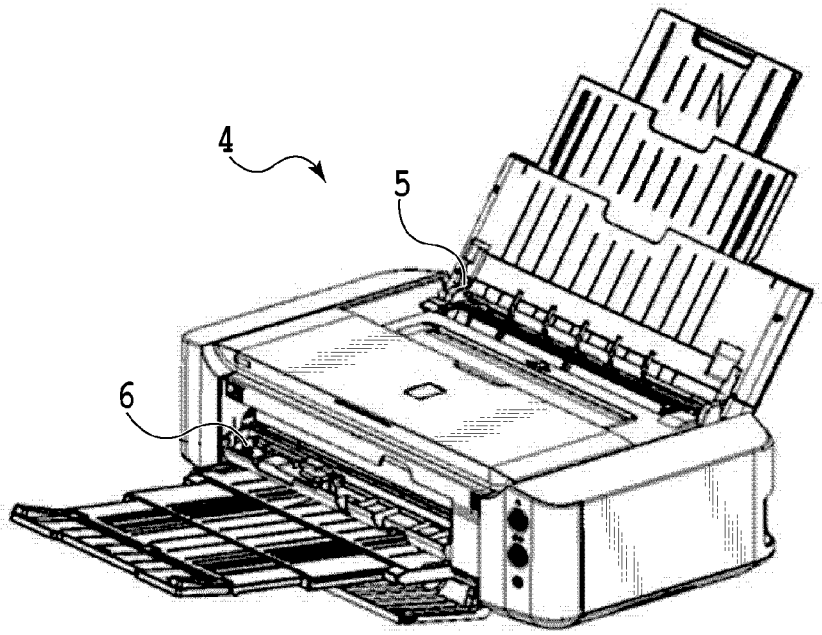
FIG. 2 is a perspective view of a printing device that is ab1e to use the carrier tray of the present invention.

FIG. 2 is a perspective view of the exterior of a printing device that is able to use the carrier tray of the present invention. In this embodiment, the printing device 4 is an inkjet type of printing device. This printing device 4 prints on flexible sheet-shaped media such as paper, plastic film and the like in a normal printing mode that supplies media to inside the printing device 4 from a media feeder 5. For example, cut paper such as normal paper or photo paper can be stacked in the media feeder 5 and fed inside the printing device 4 a sheet at a time. In the normal printing mode, media that has been fed inside the printing device 4 is printed while being conveyed in the conveyance direction that is the same as the feed direction. In the normal printing mode, the carrier tray 1 is not used.

On the other hand, the printing device 4 prints on media having a certain amount of thickness such a CD-R, DVD and the like in a carrier-tray printing mode in which media that is mounted in the carrier tray 1 is fed from a carrier-tray base 6 to inside the printing device 4. In this carrier-tray printing mode, the media is first fed to a printing start position inside the printing device 4, and then is printed while being conveyed in the conveyance direction, which is the opposite direction from the feed direction. In other words, in the normal printing mode and carrier-tray printing mode, the conveyance direction during the printing operation, and the discharge direction in which the printed media is discharged from the printing device 4 are the same.

Figure 3A:
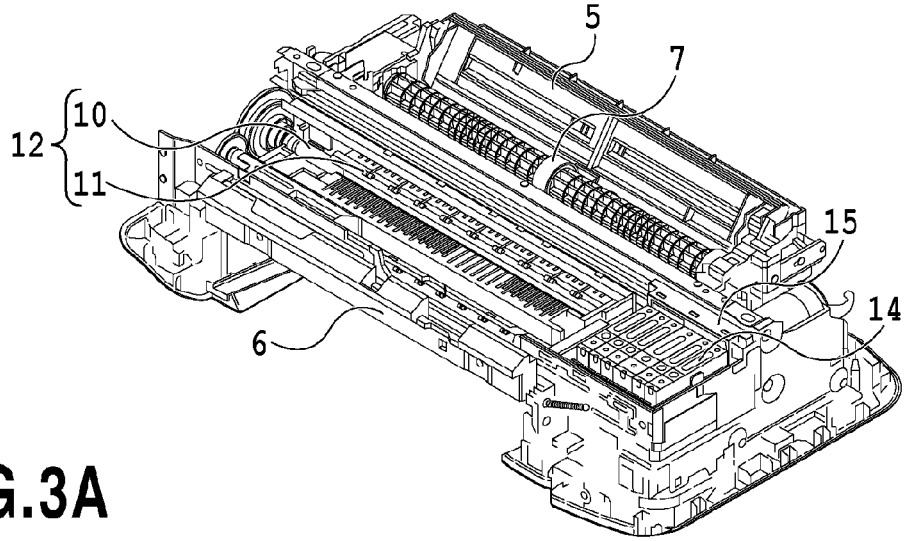
FIG. 3A and FIG. 3B are perspective views of the printing device illustrated in FIG. 2 with the exterior removed.
Figure 3B:
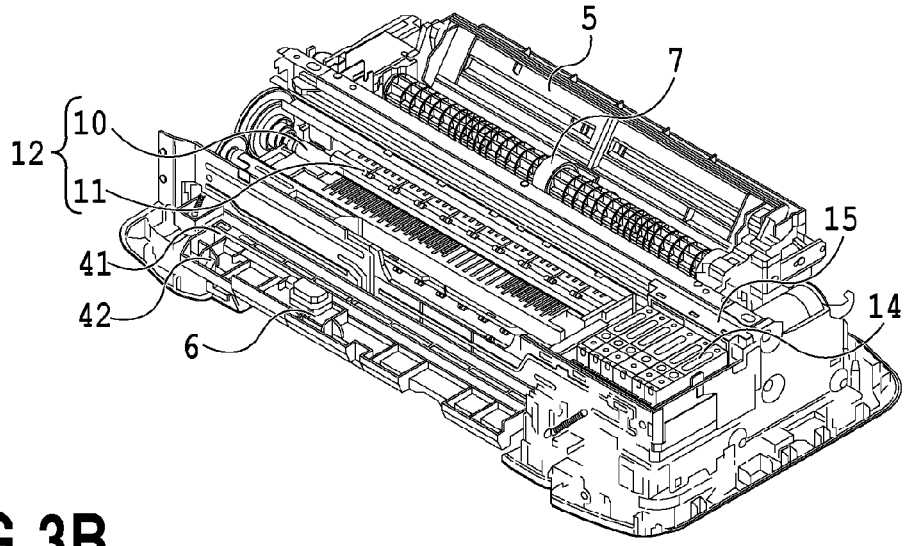
Figure 4A:
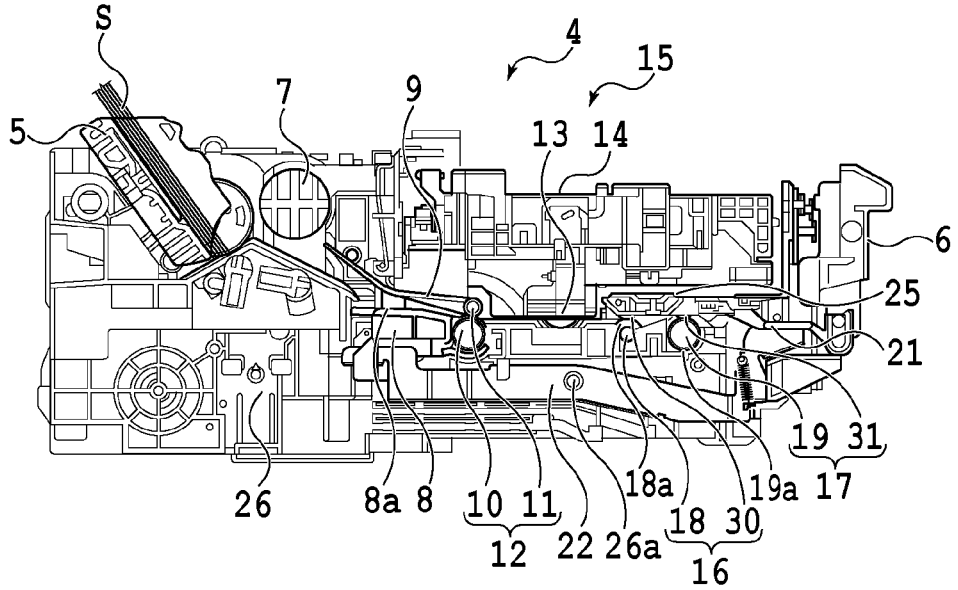
FIG. 4A and FIG. 4B are schematic cross-sectional views of the printing device illustrated in FIG. 2 with the exterior removed.
Figure 4B:
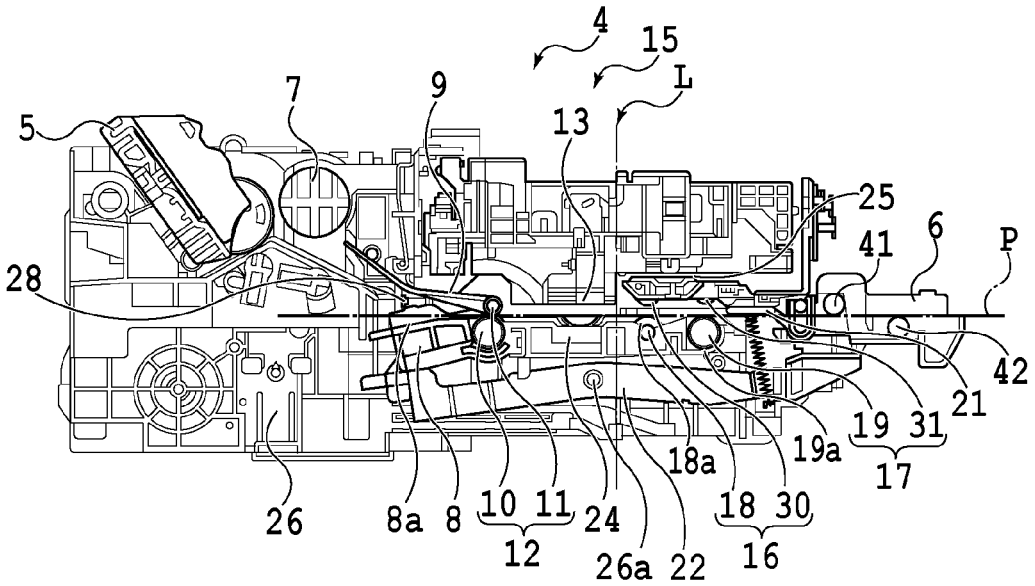

FIG. 3A and FIG. 3B are perspective views illustrating the printing device illustrated in FIG. 2 with the exterior parts removed. FIG. 4A and FIG. 4B are schematic cross-sectional views of the conveyance portion of the printing device illustrated in FIG. 2. FIG. 3A and FIG. 4A illustrate the state of the printing device in the normal printing mode in which the carrier tray is not used. FIG. 3B and FIG. 4B illustrate the state of the printing device in the carrier-tray printing mode in which the carrier tray is used.

The carrier-tray base 6 is rotatably attached to the main body of the printing device 4 so as to be opened and closed. In the normal printing mode, as illustrated in FIG. 3A and FIG. 4A, the carrier-tray base 6 is used in the closed state. On the other hand, in the carrier-tray printing mode, as illustrated in FIG. 3B and FIG. 4B, the carrier-tray base 6 is rotated from the position in the normal printing mode and is used in the open state. As a result, in the carrier-tray printing mode, the carrier tray 1 can be inserted from the carrier-tray base 6 into the printing device 4.

First, the case in which cut paper is used as the media, or in other words, the printing operation of the printing device in the normal printing mode will be summarized and explained. As illustrated in FIG. 3A and FIG. 4A, when the carrier-tray base 6 of the printing device 4 is in the closed state, cut paper S is set in the media feeder 5. The very top sheet of the cut paper S that is set is fed by a feed roller 7 into the printing device 4. The cut paper S that is fed is guided by the feed surface 8*a* of a paper guide 8 and a pinch-roller holder 9, and is fed to a conveyance roller pair 12 that comprises a conveyance roller 10 and a pinch roller 11 that is pressed by and rotates with the conveyance roller 10. After that, the cut paper S is conveyed to the printing section of the printing device 4 by the conveyance roller pair 12. In the printing section, a so-called line printer printing operation is performed in which scanning by a carriage unit 15 in which a printing head 13 and an ink tank 14 for printing are mounted, and conveyance of a media by the conveyance roller pair 12 are performed in an alternating manner. When doing this, ink is suitably ejected from ink ejection openings of the printing head 13, and printing of the desired image to be printed is performed one line at a time. After printing is finished, the cut paper S is conveyed by a first discharge roller pair 16 that is downstream in the conveyance direction of the printing section, and a second discharge roller pair 17 that is downstream in the conveyance direction from the first discharge roller pair 16, and is discharged to a discharge tray (not illustrated in the figure).

Here, the first discharge roller pair 16 comprises a first discharge roller 18 in which plural rubber rollers 18*a* are arranged so as to be spaced apart in the direction of the axis of rotation, and a spur 30 that has plural protrusions around the outer circumference and are pressed by and rotate with the plural rubber rollers 18*a* of the first discharge roller 18. Similarly, the second discharge roller pair 17 comprises a second discharge roller 19 in which plural rubber rollers 19*a* are arranged so as to be spaced apart in the direction of the axis of rotation, and a spur 31 that has plural sharp protrusions around the outer circumference and are pressed by and rotate with the plural rubber rollers 19*a* of the second discharge rollers 19.

Next, FIG. 3B and FIG. 4B will be used to summarize and explain the printing operation of the printing device in the case of printing on a CD-R, DVD or the like using the carrier tray 1, or in other words, in the carrier-tray printing mode.

First, a preparatory operation is performed in order to perform printing. The closed carrier-tray base 6 is rotated so that the end section of the carrier-tray base 6 is tilted toward the front side of the printing device (user side when in use), and the insert opening of the carrier tray is released so that a horizontal surface is formed to line up with the conveyance path inside the printing device. The carrier-tray base 6 comprises spur-base-release arms 21 and paper-guide-release links 22; each functioning as described below.

The spur-base-release arms 21 are constructed such that the tip end has a wedge shape and that one is on the left and another is on the right of the carrier-tray base 6 as seen from the front side of the printing device. By rotating and opening the carrier-tray base 6, the spur-base-release arms 21 form a guide surface for guiding the carrier tray in the printing section. When doing so, the spur-base-release arms 21 are inserted between the platen 24 that supports the first discharge roller 18 and second discharge roller 19, and the spur base 25 that supports the first spur 30 and second spur 31. By performing this operation, the first spur 30 and the second spur 31 are released approximately 5 mm upward from being pressed against the first discharge roller 18 and second discharge roller 19, and are maintained in a state of no contact with the carrier tray 1 even when the carrier tray 1 is inserted and conveyed. Therefore, construction is such that the sharp protrusions of the spurs 30 and 31 do not damage the surface of a CD-R or DVD that is mounted in the carrier tray 1, and on the other hand, the carrier tray 1 does not damage those protrusions.

The paper-guide-release links 22 are similarly provided on the left and right of the carrier-tray base 6 as seen from the front side of the printing device. By rotating the carrier-tray base 6, the paper-guide-release links 22 rotate around rotation centers 26*a* and 27*a* that are provided on the left and right frames 26 and 27, respectively. By performing the operation of rotating and opening the carrier-tray base 6, the paper-guide-release links 22 press the paper guide 8 downward against a paper-guide spring 28 that holds up the sheet guide 8. In other words, the sheet-guide-release links 22 are constructed so that the feed surface 8*a* of the sheet guide 8 moves out of the way in a direction away from the horizontal path P in order to maintain the horizontal path P, which is the conveyance path for conveying the carrier tray 1.

As the operation for releasing the carrier-tray base 6 is performed, a mechanism not illustrated in the figures positions the carriage unit 15 in which the printing head 13 is mounted at a position that is out-of-the-way further upward than the thickness of the carrier tray 1 with respect to the position in the normal printing mode where the carrier tray 1 is not used.

Figure 5:
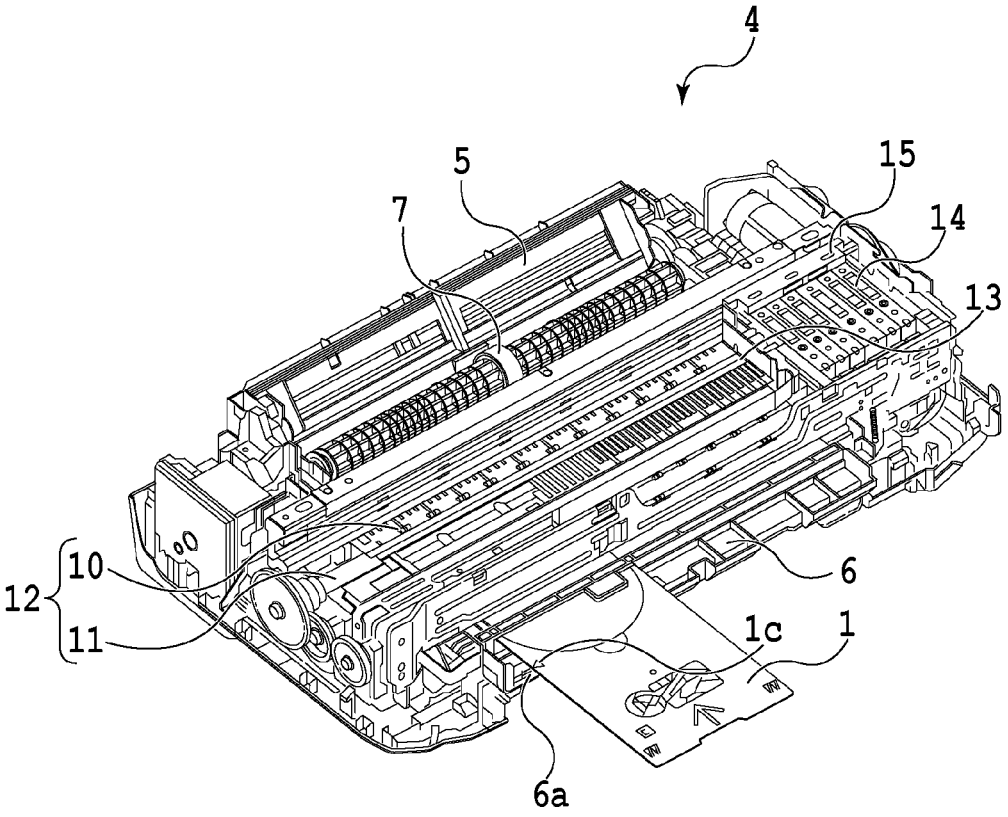
FIG. 5 is a perspective view that explains the conveyance of the carrier tray by the printing device illustrated in FIG. 2 to FIG. 4B.
Figure 6A:
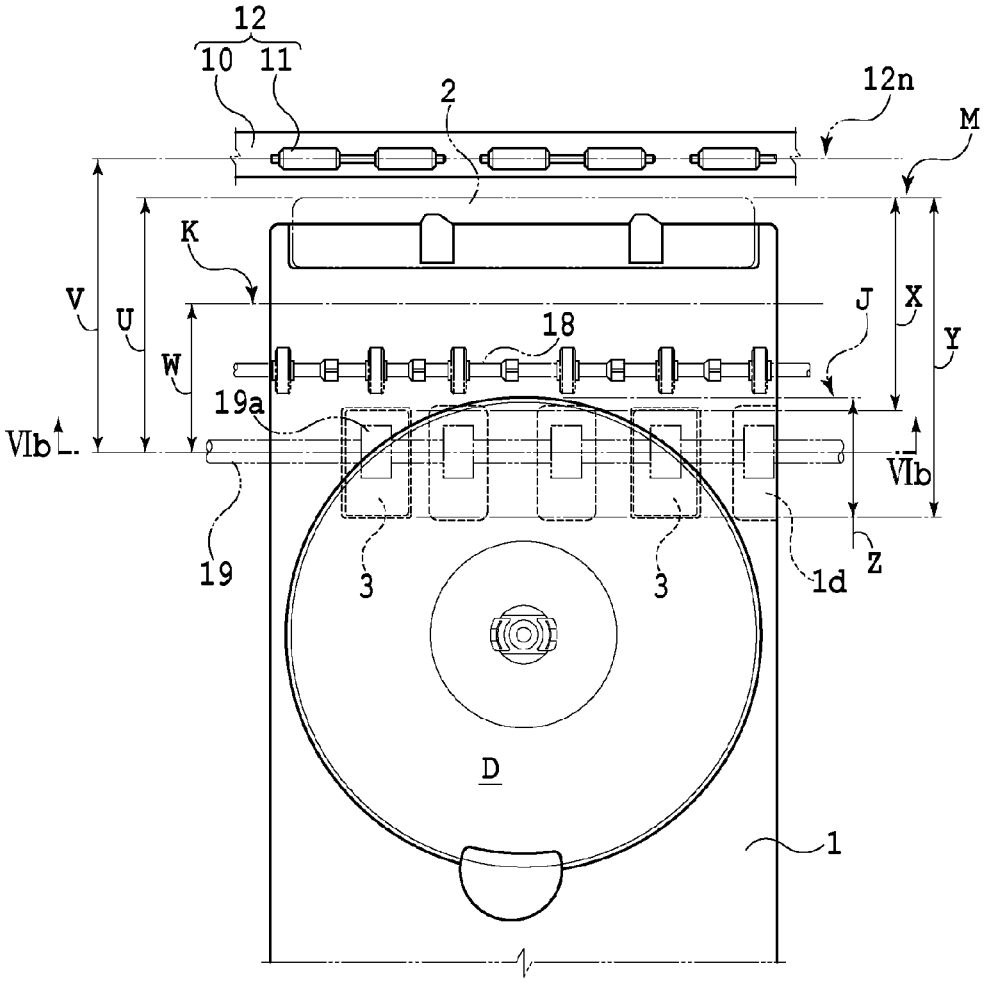
FIG. 6A and FIG. 6B are drawings for explaining the construction of a carrier tray of a first embodiment of the present invention.
Figure 6B:
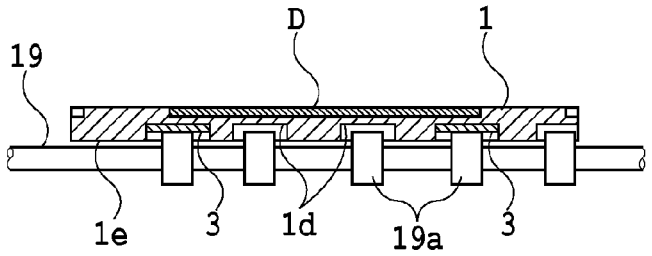

Next, the operation for inserting the carrier tray 1 will be explained using FIG. 5, FIG. 6A and FIG. 6B. FIG. 5 is a perspective view of the printing device with the exterior removed and illustrates the state in which the carrier tray 1 has been inserted by the user. FIG. 6A is a schematic top view as seen from above the area around the insertion section when the carrier tray 1 is inserted into the printing device illustrated in FIG. 5. FIG. 6B is a cross-sectional schematic view of section VIb-VIb in FIG. 6A. Here, in order to make the explanation easier to understand, the carrier tray 1 and high-friction members 3 are illustrated as transparent parts, and the members underneath are visibly indicated by solid lines or dashed lines.

The carrier tray 1 is inserted by the user to a position where a position indicator 1*c* that is provided on the carrier tray 1 coincides with a position indicator 6*a* that is provided on the carrier-tray base 6. Here, this insertion position of the carrier tray 1 will be referred to as the set position in this specification. When the carrier tray 1 is at the set position, the tray sheet 2 that is provided on the tip end of the carrier tray 1 is separated a little from the conveyance roller nip 12*n*. The reason for that is to prevent the tray sheet 2 from coming in contact with the conveyance roller 10 that is not rotating and becoming damaged.

Here, high-friction members 3 that are attached to the carrier tray 1 of the present invention will be explained. More specifically, the positional relationship between the high-friction members 3 of the carrier tray 1, and the second discharge roller 19, the conveyance-roller nip 12*n* and the printing section of the printing device 4 of this first embodiment will be explained using FIG. 1A to FIG. 1C and FIG. 6A and FIG. 6B.

First, the positional relationship between the high-friction members 3 of the carrier tray 1 and the second discharge roller 19 (first-roller section) of the printing device 4 will be explained. Depressions (concave sections) 1*d* that are a little lower than a flat surface CGV are provided on the rear surface of the carrier tray 1 at positions that correspond to rubber rollers 19*a*that are spaced around the second-discharge roller 19. In this example, as illustrated in FIG. 1C, high-friction members 3 are attached to two of the depressions 1*d*. When the step difference in the level (distance) between the flat surface 1*e* of the rear surface of the carrier tray 1 and the high-friction members 3 is taken to be H, and the direction from the flat surface 1*e* toward the bottom of the depression 1*d* is the positive direction, construction is such that the relationship H≥0 is satisfied. In other words, the top surface of the high-friction members 3 is set to a height so that the high-friction members 3 do not protrude from the flat surface 1*e* of the rear surface of the carrier tray 1. Construction is such that when the depressions 1*d* of the carrier tray 1 and the discharge roller 19 are positioned so as to face each other, the rubber rollers 19*a* of the discharge roller 19 come in contact with the high-friction members 3 in the depressions 1*d*.

In this example, construction is such that high-friction members 3 are attached to two depressions 1*d*. However, the number of depressions 1*d* to which high-friction members 3 are attached is not limited. For example, construction is possible in which high-friction members 3 are attached to all of the depressions 1*d*, and construction is also possible in which a high-friction member 3 is attached to only one depression 1*d*. From the aspect of preventing shifting of the conveyance position, such as diagonal movement during conveyance of the carrier tray 1, preferably high-friction members 3 are provided for a pair/pairs of depressions 1*d* at positions that are symmetric about an imaginary centerline that extends along the carrier tray 1 in the conveyance direction.

Moreover, in this example, construction is such that high-friction members 3 are attached to the carrier tray 1 as separate parts. However, the present invention is not limited to this construction as long as there are high-friction surfaces at the positions of the depressions 1*d* having a higher coefficient of friction than the other portions of the carrier tray 1. For example, high-friction members can be integrally manufactured with the carrier tray 1 by two-color molding, or high-friction surfaces can be formed by coating the carrier tray 1 in a later process. When doing this, the difference in level H between the flat surface 1*e* of the rear surface of the carrier tray 1 and the high-friction members 3 (high-friction surfaces) is set so as to satisfy the relationship above of H≥0. In the case in which the relationship H<0 is satisfied and high-friction members 3 protrude from the flat surface 1*e* of the rear surface of the carrier tray 1, the roller is lifted up by the amount of protrusion, and there is a possibility that shifting in the conveyance position such as fluctuation in height or diagonal movement of the carrier tray 1 inside the printing device 4 will occur, so in order to prevent this, the relationship H≥0 should be satisfied.

Next, the position of the high-friction members 3 of the carrier tray 1 in the printing device 4, and more specifically, the positional relationship between the high-friction members 3, the conveyance roller pair 12 (second roller section) and the printing section will be explained. In this explanation, the distance V in the printing device 4, and the distances X and Y in the carrier tray 1 will be defined as below, and the position of the high-friction members 3 will be explained from the relationship of these distances.

Distance V: Distance from the second discharge roller 19 to the nip 12*n* of the conveyance roller pair 12.

Distance X: Distance from the tip end of the carrier tray 1 to the near end part of the high-friction members 3.

Distance Y: Distance from the tip end of the carrier tray 1 to the far end part of the high-friction members 3.

In this embodiment, the "tip end of the carrier tray 1" is the tip end of the tray sheet 2 that is provided on the tapered-shape portion 1*b* of the carrier tray 1. However, the tray sheet 2 is not an essential component of the present invention, and construction in which a tray sheet 2 is not provided on the tip end of the carrier tray 1 is also within the scope of the present invention. In construction in which there is no member such as a tray sheet 2 provided so as to protrude toward the front from the tip end of the carrier tray 1, the "tip end of the carrier tray 1" is literally the tip end of the carrier tray 1.

In this embodiment, the high-friction members 3 are constructed and positioned so that the distances V, X and Y satisfy the relationship X<V<Y. According to this positional relationship, before, during and after the operation of the carrier tray 1 advancing to the nip 12*n* of the conveyance roller pair 12 it becomes possible for the high-friction members 3 and rubber rollers 19*a* of the second discharge roller 19 to be in a state of contact. As a result, the driving force of the discharge roller 19 is sufficiently transmitted to the carrier tray 1 and it is possible to obtain the desired conveying force, and thus it is possible to suppress shifting in the conveyance position such as diagonal movement.

Next, more preferred construction will be explained. Lines J, K and M and distances U, W and Z are defined as below.

Line J: Line that indicates a position on the carrier tray 1 of the end section of the media D that is mounted in the carrier tray 1 on the side near the tip end of the carrier tray 1, Line K: Line that indicates the position inside the printing device 4 of the end section of the media D that is mounted in the carrier tray 1 on the side near the tip end of the carrier tray 1 when printing the final line on the media D that is mounted in the carrier tray 1.

Line M: Line that indicates the position inside the printing device 4 where the tip end of the carrier tray 1 reaches when the user has inserted the carrier tray 1 to the set position.

Distance U: Distance between the second discharge roller 19 and line M.

Distance W: Distance between the second discharge roller 19 and line K.

Distance Z: Distance from the end section of the media D that is mounted in the carrier tray 1 on the side near the tip end of the carrier tray 1 (Line J) to the far end part of the high-friction members 3 from the tip end of the carrier tray 1.

When defined in this way, the positional relationship is set so as to satisfy the expression U≥X. According to this positional relationship, when the user has inserted the carrier tray 1 to the set position, the high-friction members 3 and the rubber rollers 19*a* of the second discharge roller 19 are in a state of contact. As a result, the driving force of the second discharge roller 19 can be sufficiently transmitted to the carrier tray 1, and it is possible to obtain the desired conveying force when the tip of the carrier tray 1 reaches the nip 12*n* of the conveyance roller pair 12.

Moreover, the positional relationship is set so that the expression W>Z is satisfied, so that during printing of the media D there is always a state of no contact between the high-friction members 3 and the rubber rollers 19*a* of the second discharge roller 19. With this positional relationship, it becomes difficult for fluctuation of the height of the carrier tray 1 inside the printing device 4 due to a difference in level between the flat surface 1*e* of the rear surface of the carrier tray 1 and the high-friction members 3, and for shifting of the conveyance position such as diagonal movement due to fluctuation in the conveying force to occur during the printing operation.

In the construction described above, the states of conveying the carrier tray 1 from inserting the carrier tray 1 into the printing device 4 until the media D is printed will be explained using FIG. 7A to FIG. 7F and FIG. 8A to FIG. 8F.

Figure 7A:
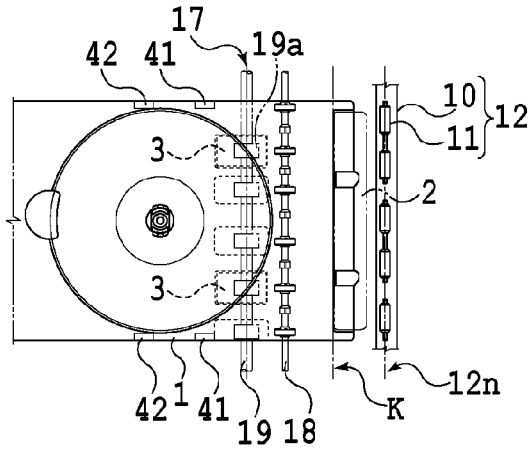
FIG. 7A to FIG. 7F are top views for explaining the operation when printing using the carrier tray of the present invention.
Figure 8A:
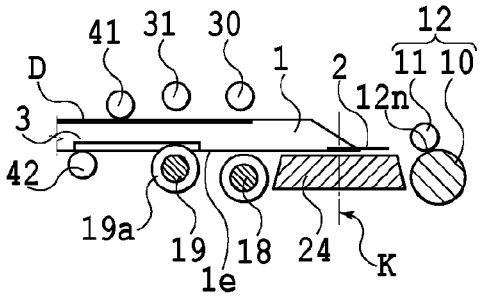
FIG. 8A to FIG. 8F are cross-sectional views for explaining the operation when printing using the carrier tray of the present invention.

FIG. 7A is a top schematic view illustrating the state in which the user has inserted the carrier tray 1 to the set position, and FIG. 8A is a cross-sectional view of the same state. The carrier tray 1 that has been inserted by the user is located such that the tray sheet 2 on the tip end is a little in front of reaching the nip 12*n* of the conveyance roller pair 12. The reason that this position is taken to be the set position is that if the tray sheet 2 were to be brought into contact with the stopped conveyance roller pair 12, there is a possibility that the tip end of the tray sheet 2 could be damaged.

The rear-end side of the carrier tray 1 is such that the rear surface 1*e* of the carrier tray 1 is supported by follower rollers 42 that are provided on the carrier-tray base 6. Pressure rollers 41 that are provided between the second discharge roller 19 and the follower rollers and press the top surface of the carrier tray 1 by springs (not illustrated in the figures) are provided on the top surface of the carrier tray 1. The pressure rollers 41 maintain a state such that the high-friction members 3 and the rubber rollers 19*a* of the second discharge roller 19 are in actual contact. The depressions 1*d* where the high-friction members 3 are not attached to are in a state of no contact with the rubber rollers 19*a*. In this state, construction is such that portions of the flat surface 1*e* of the rear surface of the carrier tray 1 are positioned between the plural rubber rollers 19*a*. Therefore, there is also no contact between those portions on the flat surface 1*e* and the rubber rollers 19*a*.

In order to draw the carrier tray 1 from this state into the printing device 4, the second discharge roller 19 (first roller section) and the conveyance roller pair 12 (second roller section) are caused to rotate by a drive mechanism (not illustrated in the figures). In this state, because the rubber rollers 19*a* of the second discharge rollers 19 are in contact with the high-friction members 3 of the carrier tray 1, the driving force of the discharge roller 19 is transmitted to the carrier tray 1 and a sufficient conveying force is generated.

By each of the distances satisfying the relationship X<V<Y, at a position just before and after the tip end of the carrier tray 1 enters into the nip 12*n* of the conveyance roller pair 12, the rubber rollers 19*a* of the second discharge roller 19 and the high-friction members 3 of the carrier tray 1 are maintained in a state of contact. Moreover, by each of the distances satisfying the relationship U≥X, during the period from when the carrier tray 1 is conveyed from the set position until the tip end of the carrier tray 1 reaches the conveyance roller pair 12 as well, the rubber rollers 19*a* of the second discharge rollers 19 and the high-friction members 3 of the carrier tray 1 are kept in a state of contact. Therefore, the tray sheet 2 on the tip end of the carrier tray 1 is conveyed to the conveyance roller pair 12 by a sufficient conveying force. The tray sheet 2 on the tip end of the carrier tray 1 that has been conveyed up to the nip 12*n* of the conveyance roller pair 12 is then drawn into the nip 12*n* of the conveyance roller pair 12 and is in the state illustrated in FIG. 7B and FIG. 8B.

Figure 7D:
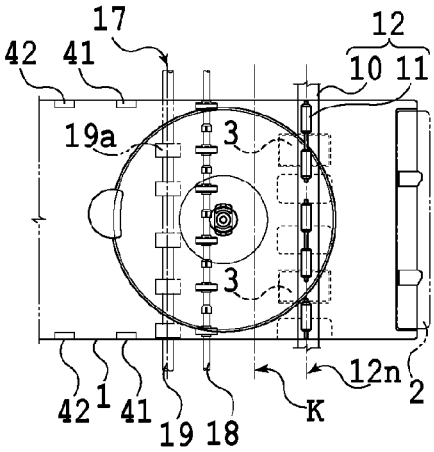
Figure 7B:
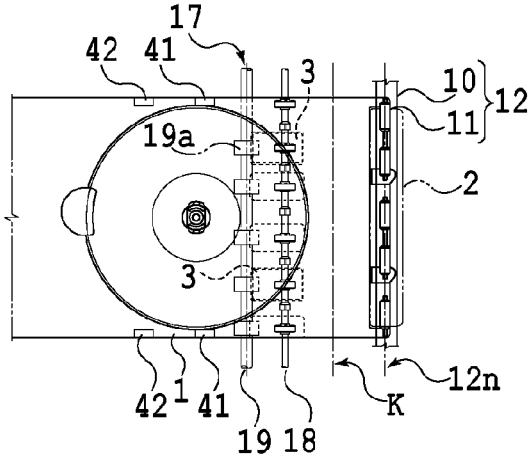
Figure 8D:
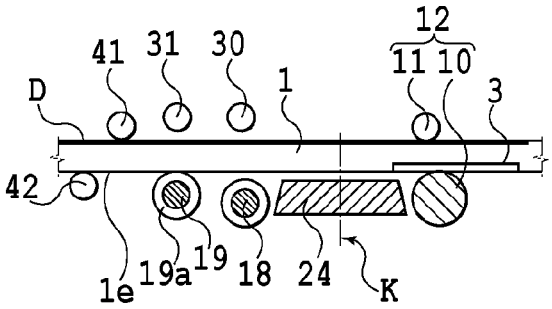
Figure 8B:
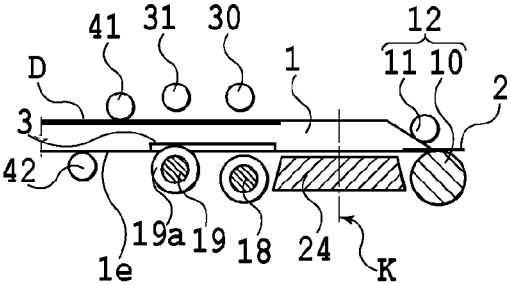

FIG. 7B is a top schematic view illustrating the state in which the area near the tip end of the carrier tray 1 has reached the conveyance roller pair 12 and has been drawn in a little, and FIG. 8B is a cross-sectional schematic view of that state. After the tip end of the carrier tray 1 has been taken into the conveyance roller pair 12, the carrier tray 1 is conveyed in a state of the rear surface being supported by the second discharge roller 19 and the conveyance roller 10. Here, the carrier tray 1 is in a state of no contact with the first discharge roller 18. In a state in which the top surface of the carrier tray 1 is pressed by a pinch roller 11, the flat surface 1e of the rear surface of the carrier tray 1 comes in contact with the conveyance roller 10 and conveyed, so the carrier tray 1 is conveyed by a sufficient conveying force. Moreover, here, the rubber rollers 19*a* of the second discharge roller 19 are also in contact with the high-friction members 3 of the carrier tray 1 and rotate, so assist in conveyance of the carrier tray 1.

Figure 7E:
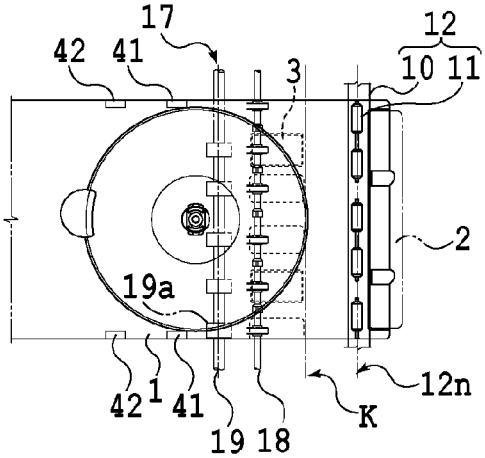
Figure 7C:
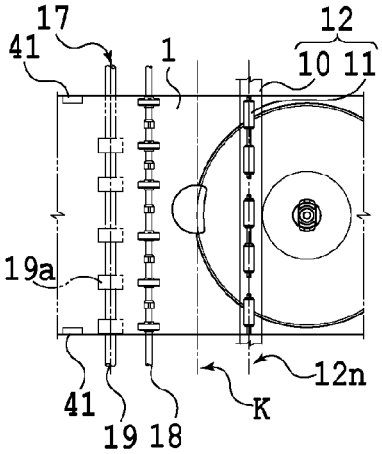
Figure 8E:
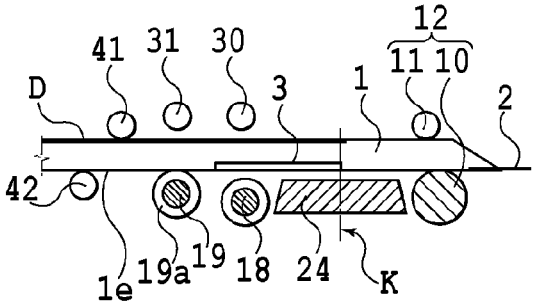
Figure 8C:
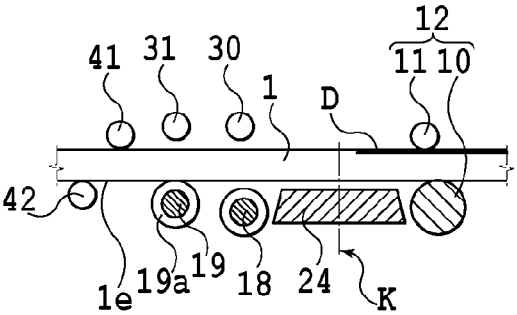

FIG. 7C is a top schematic view of the state in which the carrier tray 1 is drawn in by the conveyance roller pair 12 and has reached the printing start position, and FIG. 8C is a cross-sectional schematic view of that state. Printing on the media D that is mounted in the carrier tray 1 is started after the user has inserted the carrier tray 1 to the set position, and the carrier tray 1 is drawn in a direction toward the back of the printing device to the printing start position by the operation described above. The conveyance direction of the carrier tray when printing on the media D is in the opposite direction from the direction that the carrier tray 1 was drawn in, and is the direction toward the front side of the printing device 4.

FIG. 7D is a top schematic view of the state in which printing near the center of the media D is performed, and is a state in which the high-friction members 3 pass by the conveyance roller 10, and FIG. 8D is a cross-sectional schematic view of that state. The high-friction members 3 are constructed so as not to protrude further than the flat surface 1*e* of the rear surface of the carrier tray 1, so the high-friction members 3 do not come in contact with the conveyance roller 10. Therefore, it is possible to perform printing stably without the occurrence of fluctuation in the position in the height direction or shifting of the conveyance direction of the carrier tray 1 inside the printing device 4 due to contact with the conveyance roller 10 that may occur in the case where the high-friction members 3 protrude.

FIG. 7E is a top schematic view of the state in which printing of the last line on the media D has finished, and FIG. 8E is a cross-sectional schematic view of that state. The carrier tray 1 is conveyed in a state in which the flat surface 1*e* of the rear surface of the carrier tray 1 is in contact with the conveyance roller 10. By the distances satisfying the relationship W>Z described above, in this state the high-friction members 3 have not yet reached the second discharge roller 19. Therefore, it is possible to perform printing stably without the occurrence of fluctuation of the height position or shifting of the conveyance direction of the carrier tray 1 inside the printing device 4.

Figure 7F:
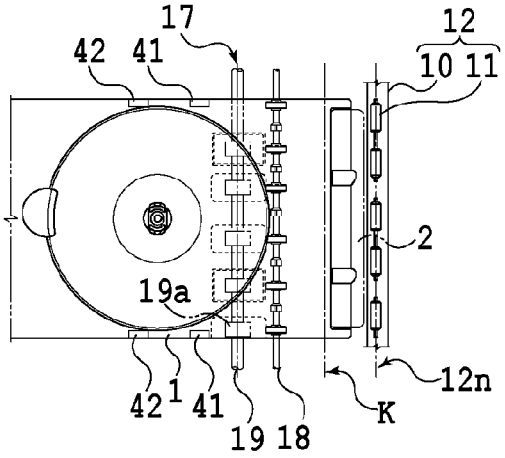
Figure 8F:
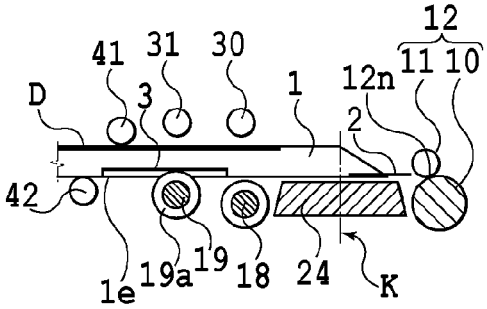

FIG. 7F is a top schematic view of the state in which printing on the media D is finished, and the carrier tray 1 is discharged toward the outside of the printing device 4 by the second discharge roller 19, and FIG. 8F is a cross-sectional schematic view of that state. The high-friction members 3 of the carrier tray 1 have arrived at the second discharge roller 19. By the distances satisfying the expressions X<V<Y and U≥X above, in this state, the tray sheet 2 has passed by the nip 12*n* of the conveyance roller pair 12. The carrier tray 1 is discharged by a sufficient conveying force that is brought about by the contact between the rubber rollers 19*a* of the second discharge roller 19 and the high-friction members 3 of the carrier tray 1.

With the construction of this embodiment as explained above, the carrier tray is able to be stably conveyed before, during and after the tip end of the carrier tray is taken in by the nip 12*n* of the conveyance roller pair 12. Moreover, after printing is finished, it is possible to smoothly discharge the carrier tray without the tip end of the carrier tray remaining near the nip of the conveyance roller pair.

This embodiment was explained for construction that comprises two discharge rollers: a first discharge roller and a second discharge roller. However, as long as construction is such that the relationship between the second discharge roller and high-friction members of this embodiment is satisfied, the number of discharge rollers in this embodiment is not limited, and it is possible to use one or three or more.

(Second Embodiment)

Figure 9:
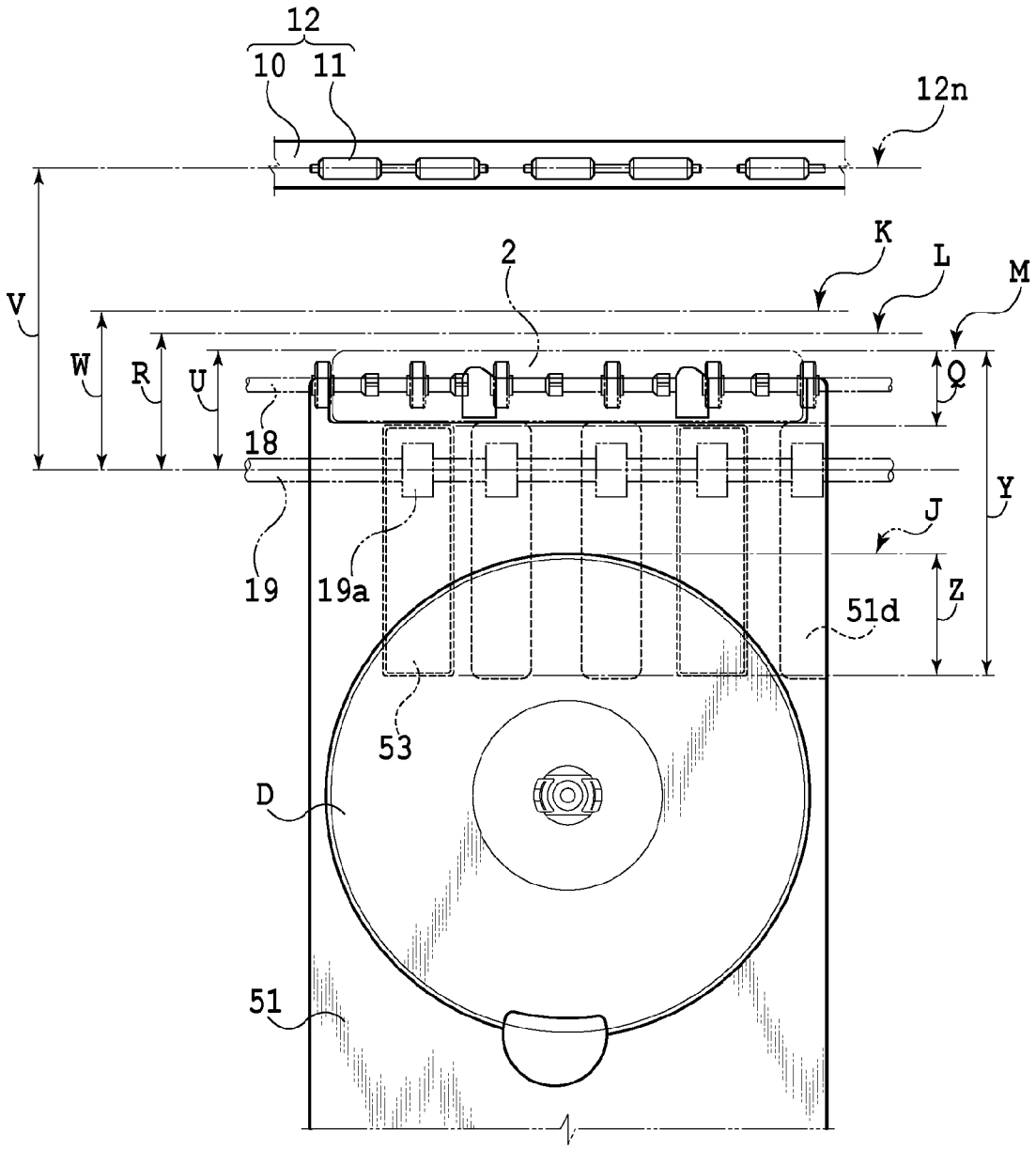
FIG. 9 is a drawing for explaining the construction of a carrier tray of a second embodiment of the present invention.
Figure 10:
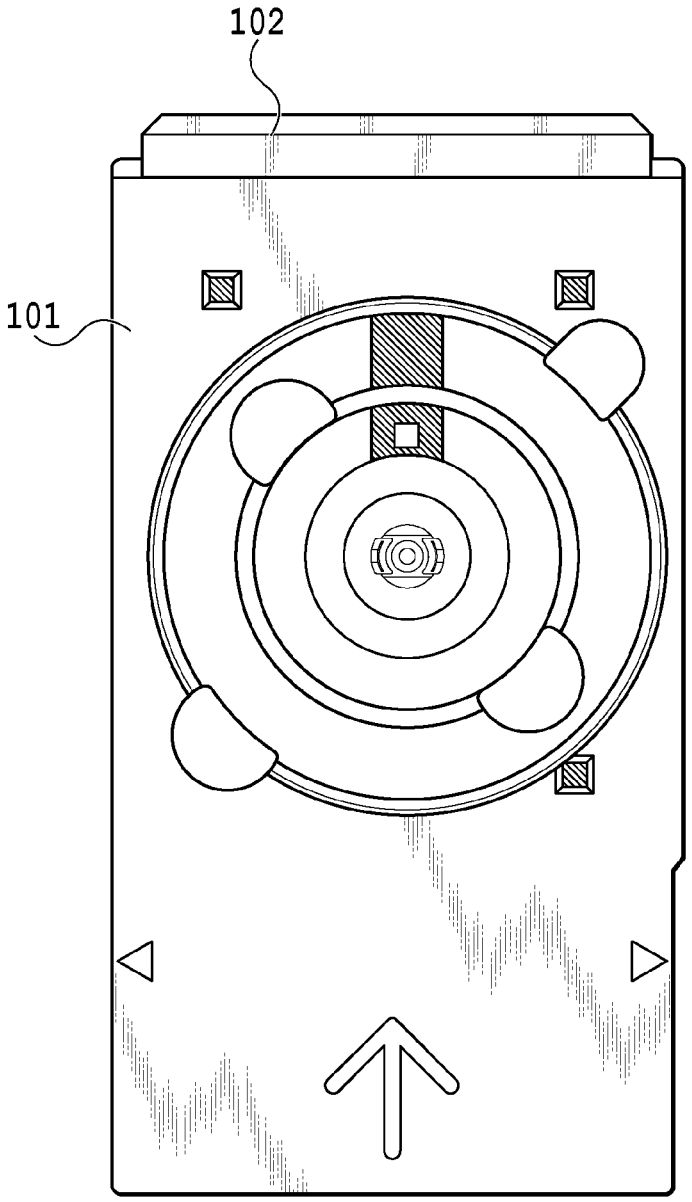
FIG.10 (CONVENTIONAL ART)
FIG. 10 is a top view that illustrates a conventional carrier tray.
Figure 11:
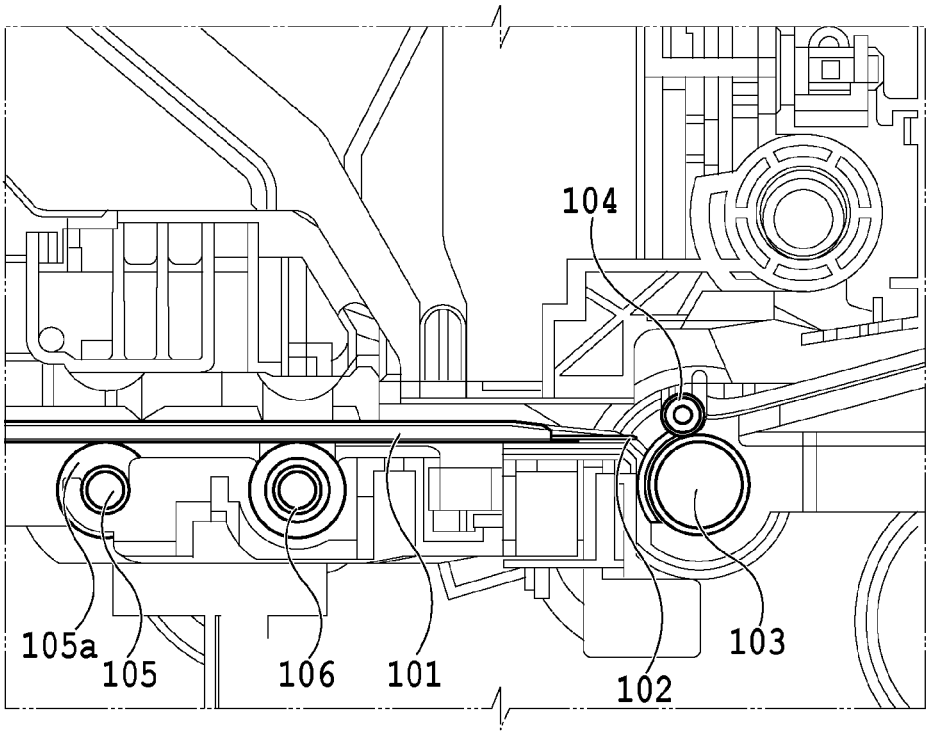
FIG.11 (CONVENTIONAL ART)
FIG. 11 is a schematic cross-sectional view of a printing device that conveys a conventional carrier tray.

A second embodiment of the present invention is explained using FIG. 4B and FIG. 9. In the figures, the same or similar reference numbers and symbols are used for construction that is the same or similar to that of the first embodiment, and explanation thereof is omitted.

FIG. 9 is a top view that illustrates the state in which printing on the media D is finished, and the carrier tray 51 on which the media D is mounted is being discharged from the printing device 4. In this explanation, some distances and lines are defined, and the position of high-friction members is explained from the relationships between these distances. Lines J and K, and distances U, V, W, X, Y and Z are the same as in the first embodiment so explanations of the definitions thereof will be omitted.

Line L: Line that indicates the position inside the printing device 4 of the end section of the printing head 13 on the downstream side in the discharge direction of the carrier tray 51. In other words, is a line that indicates the end section on the downstream side in the discharge direction of the carrier tray 51 of the area inside the printing device 4 where the scanning printing head 13 that is mounted in the carriage unit 15 passes.

Distance Q: Distance from the tip end of the carrier tray 51 to the near end part of the high-friction members 53.

Distance R: Distance between the second discharge roller 19 and the line L.

The high-friction members 53 are constructed so as to be located at positions where the distances V, Q and Y satisfy the relationship Q<V<Y. Therefore, in this second embodiment as well, there is a state of contact between the high-friction members 53 and the rubber rollers 19*a* of the second discharge roller 19 before, during and after the tip end of the carrier tray 51 is taken into the nip 12*n* of the conveyance roller pair 12. As a result, the driving force of the second discharge roller is sufficiently transmitted to the carrier tray 51, and the desired conveying force can be obtained.

For more preferable construction, the positional relationship is set so that the distances U and Q satisfy the relationship of the equation U≥Q. With this positional relationship, there is contact between the high-friction members 53 and the rubber rollers 19*a* of the second discharge rollers 19 at the set position where the carrier tray 51 is inserted by the user. Therefore, conveying force up to where the tip end of the carrier tray 51 reaches the nip 12*n* of the conveyance roller pair 12 can be sufficiently obtained.

For even more preferable construction, the high-friction members 53 are constructed so that the distances R and Q, which are a feature of this second embodiment, satisfy the relationship R≥Q. With this positional relationship, the tip end of the carrier tray 51 can be certainly discharged from the area where the printing head 13 passes after printing on the media D is finished.

As described above, with the present invention, in a printing device that prints on media that is held in a carrier tray, it is possible to sufficiently transmit the driving force of rollers used in conveyance to the carrier tray, and to obtain a desired conveying force, and thus it is possible to suppress problems such as poor conveyance or shift in the position. The present invention can also be applied to conveying devices that convey a tray-shaped object to be conveyed by the driving force of conveyance rollers.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-269501 filed Dec. 26, 2013, which is hereby incorporated by reference wherein in its entirety.

What is claimed is:

1. A printing device that prints on media that is held in a tray, comprising:

a first roller section that comprises a first conveyance roller;

a second roller section that comprises a second conveyance roller and a pinch roller; and a printing section that is provided between the first roller section and the second roller section, wherein printing is performed on the top surface of the media in the printing section while the tray is being conveyed by the first roller section and the second roller section, the tray includes a first region and a second region having a coefficient of friction that is higher than that of the first region, the first and second regions being aligned in a conveyance direction of the tray on a side of a surface that comes in contact with the first conveyance roller, and the second region is provided at a portion that comes in contact with the first conveyance roller when the tray is taken in by the first roller section and a tip end of the tray advances to a gripping section between the second conveyance roller and the pinch roller.

2. The printing device according to claim 1, wherein printing is performed on a surface of the media in the printing section while the tray is conveyed in a direction opposite the direction that the tray was taken in.

3. The printing device according to claim 1, wherein the second region is provided so that the first roller section does not come in contact with the second region when the media is facing the printing section.

4. The printing device according to claim 1, wherein the distance from the tip end of the tray to the near end part of the second region is less than the distance from a position where the first roller section comes in contact with the tray to the gripping section.

5. The printing device according to claim 1, wherein the distance from the tip end of the tray to the far end part of the second region is greater than the distance from the position where the first roller section comes in contact with the tray to the gripping section.

6. The printing device according to claim 1, wherein when the tray is set at a set position where the tray begins to be taken in, the distance from the tip end of the tray to the near end part of the second region is less than the distance from the position where the first roller section comes in contact with the tray to the tip end of the tray.

7. The printing device according to claim 1, wherein when the tray is set at a set position where the tray begins to be taken in, the tip end of the tray is positioned between the gripping section and the first roller section, and the second region is provided so that the second region comes in contact with the first conveyance roller.

8. The printing device according to claim 1, wherein the second region is provided so that when it is possible for the printing section to perform printing on the top surface of the media that is held in the tray, the first roller section is in a state of no contact with the second region.

9. The printing device according to claim 1, wherein a concave section is formed in the tray, a member having a coefficient of friction that is higher than that of the first region is attached to the concave section and the member does not protrude from the concave section.

10. The printing device according to claim 9, wherein the first conveyance roller is divided into plural rollers that are arranged so as to be spaced along the direction of the axis of rotation and plural concave sections are formed in the tray, and the concave sections are formed at positions that correspond to these plural rollers.

11. The printing device according to claim 1, wherein the first conveyance roller is divided into plural rollers that are arranged so as to be spaced along the direction of the axis of rotation, and the tray includes a plurality of the second regions having a coefficient of friction that is higher than both sides thereof in the conveyance direction and being arranged in a direction crossing the conveyance direction so as to interpose a region having a coefficient of friction that is lower than that of the second regions and to correspond to the plural rollers.

12. A tray that is constructed so as to hold media and that is used in a printing device that performs printing on media that is held in the tray, the printing device comprising:

a first roller section that comprises a first conveyance roller;

a second roller section that comprises a second conveyance roller and a pinch roller; and a printing section that is provided between the first roller section and the second roller section, wherein the printing device performs printing on a surface of the media in the printing section while the tray is being conveyed by the first roller section and the second roller section, the tray includes a first region and a second region having a coefficient of friction that is higher than that of the first region, the first and second regions being aligned in a conveyance direction of the tray on a side of a surface that comes in contact with the first conveyance roller, and the second region is provided at a portion that comes in contact with the first conveyance roller when the tray is taken in by the first roller section and a tip end of the tray advances to a gripping section between the second conveyance roller and the pinch roller.

13. The tray according to claim 12, wherein the first conveyance roller of the printing device is divided into plural rollers that are arranged so as to be spaced along the direction of the axis of rotation, and the tray includes a plurality of the second regions having a coefficient of friction that is higher than both sides thereof in the conveyance direction and being arranged in a direction crossing the conveyance direction so as to interpose a region having a coefficient of friction that is lower than that of the second regions and to correspond to the plural rollers.

14. A conveyance device that conveys a tray that holds media, comprising:

a first roller section that comprises a first conveyance roller; and a second roller section that comprises a second conveyance roller and a pinch roller, wherein the tray includes a first region and a second region having a coefficient of friction that is higher than that of the first region, the first and second regions being aligned in a conveyance direction of the tray on a side of a surface that comes in contact with the first conveyance roller, and the second region is provided at a portion that is in contact with the first conveyance roller when the tray is taken in by the first roller section and a tip end of the tray advances to a gripping section between the second conveyance roller and the pinch roller.

15. The conveyance device according to claim 14, wherein the first conveyance roller is divided into plural rollers that are arranged so as to be spaced along the direction of the axis of rotation, and the tray includes a plurality of the second regions having a coefficient of friction that is higher than both sides thereof in the conveyance direction and being arranged in a direction crossing the conveyance direction so as to interpose a region having a coefficient of friction that is lower than that of the second regions and to correspond to the plural rollers.

* * * * *